United States Patent [19]

Reich

[11] Patent Number: 4,494,963

[45] Date of Patent: Jan. 22, 1985

[54] SYNTHESIS GAS GENERATION APPARATUS

[75] Inventor: Erwin A. Reich, Stamford, Conn.

[73] Assignee: Texaco Development Corporation, White Plains, N.Y.

[21] Appl. No.: 507,266

[22] Filed: Jun. 23, 1983

[51] Int. Cl.[3] ..... C10J 3/48; C10J 3/52; C10J 3/84

[52] U.S. Cl. ..... 48/69; 48/DIG. 2; 55/256

[58] Field of Search ..... 48/69, DIG. 2, 76, 206, 48/128; 55/256, 269; 122/7 R

[56] References Cited

U.S. PATENT DOCUMENTS

| | | | |
|---|---|---|---|
| 2,818,326 | 12/1957 | Eastman et al. | 48/206 |
| 2,961,310 | 11/1960 | Steever | 48/206 |
| 3,561,194 | 2/1971 | Baldwin et al. | 55/256 |
| 4,002,438 | 1/1977 | Fleming | 48/76 |
| 4,328,006 | 5/1982 | Muenger et al. | 55/269 |
| 4,372,253 | 2/1983 | Hibbel et al. | 122/7 R |

FOREIGN PATENT DOCUMENTS

| | | | |
|---|---|---|---|
| 899094 | 1/1982 | U.S.S.R. | 55/256 |

*Primary Examiner*—Peter Kratz

*Attorney, Agent, or Firm*—Robert A. Kulason; Carl G. Seutter

[57] ABSTRACT

A synthesis gas generator includes in a preferred embodiment a quench portion wherein product gas is passed downwardly through a first contacting zone in contact with a downwardly descending film of cooling liquid, then preferably at a decreasing velocity through an expanded second contacting zone, and then through a body of aqueous cooling liquid in a third contacting zone, preferably followed by a baffled vapor-liquid disengaging zone prior to withdrawal of product gas from said generator.

2 Claims, 3 Drawing Figures

SYNTHESIS GAS GENERATION APPARATUS

FIELD OF THE INVENTION

This invention relates to a cooling apparatus. More particularly it relates to a method for cooling a hot synthesis gas under conditions to remove solids therefrom and to thereby prevent their deposition on pieces of equipment during further processing.

BACKGROUND OF THE INVENTION

As is well known to those skilled in the art, it is difficult to satisfactorily cool hot gases, typically at temperatures as high as 1200° F. or higher and particularly so when these gases contain particulates including ash and char. Typical of such gases may be a synthesis gas prepared as by incomplete combustion of a liquid or gaseous hydrocarbon charge or a solid carbonaceous charge. The principal desired gas phase components of such a mixture may include carbon monoxide and hydrogen; and other gas phase components may be present including nitrogen, carbon dioxide, and inert gases. The synthesis gas so prepared is commonly found to include non-gaseous (usually solid) components including those identified as ash, which is predominantly inorganic, and char which is predominantly organic in nature and includes carbon.

A particularly severe problem arises if the solids content of the gas is not lowered. Synthesis gases as produced may (depending on the charge from which they are prepared) typically contain about 4 pounds of solids per 1000 SCF of dry gas. These solids may deposit and plug the apparatus if they are not removed.

It has heretofore been found to be difficult to remove small particles of solids including ash, slag, and/or char from synthesis gases. These particles, typically of particle size of as small as 5 microns or less, have been found to agglomerate (in the presence of water-soluble components which serve as an interparticle binder) into agglomerates which may typically contain about 1 w % of these water-soluble components. These agglomerates deposit at random locations in the apparatus typified by narrow openings in or leading to narrow conduits, exits, etc., and unless some corrective action is taken to prevent build-up, may plug the apparatus to a point at which it is necessary to shut down after an undesirably short operation period.

It is an object of this invention to provide a process and apparatus for cooling hot gases and for minimizing plugging of lines. Other objects will be apparent to those skilled in the art.

STATEMENT OF THE INVENTION

In accordance with certain of its aspects, this invention is directed to the method of cooling from an initial high temperature to a lower final temperature, a hot synthesis gas containing solids under conditions which permit removal of solids from said gas which comprises passing said hot synthesis gas at initial high temperature downwardly through a first contacting zone;

passing cooling liquid downwardly as a film on the walls of said first contacting zone and in contact with said downwardly descending synthesis gas thereby cooling said synthesis gas and forming a cooled synthesis gas;

passing said cooled synthesis gas downwardly into a second contacting zone, of larger cross-sectional area than the cross-sectional area of said first contacting zone thereby forming an expanded synthesis gas;

passing said expanded synthesis gas into contact with a body of aqueous cooling liquid in a third contacting zone thereby forming a further cooled synthesis gas containing a decreased content of solid particles; and recovering said further cooled synthesis gas containing a decreased content of solid particles.

In accordance with certain of its other aspects, this invention is directed to the method of cooling from an initial high temperature to a lower final temperature, a hot synthesis gas containing solids under conditions which permit removal of solids from said gas which comprises passing said hot synthesis gas at initial high temperature downwardly through a first contacting zone;

passing cooling liquid downwardly as a film on the walls of said first contacting zone and in contact with said downwardly descending synthesis gas thereby cooling said synthesis gas and forming a cooled synthesis gas;

passing said cooled synthesis gas into contact with a body of aqueous cooling liquid in a second contacting zone thereby forming a further cooled synthesis gas containing a decreased content of solid particles;

withdrawing said further cooled synthesis gas containing a decreased content of solid particles upwardly from said body of aqueous cooling liquid in said second contacting zone passing said further cooled synthesis gas containing a decreased content of solid particles through an arcuate path terminating with a substantial downward component of velocity whereby the non-gaseous components in said further cooled synthesis gas are downwardly directed toward said body of aqueous cooling liquid thereby forming a synthesis gas stream of lower solids content;

passing said synthesis gas stream of lower solids content upwardly away from said body of aqueous cooling liquid as a synthesis gas containing a decreased content of solid particles; and recovering said further cooled synthesis gas containing a decreased content of solid particles.

In accordance with certain of its other aspects, this invention is directed to the method of cooling from an initial high temperature to a lower final temperature, a hot synthesis gas containing solids under conditions which permit removal of solids from said gas which comprises passing said hot synthesis gas at initial high temperature downwardly through a first contacting zone;

passing cooling liquid downwardly as a film on the walls of said first contacting zone and in contact with said downwardly descending synthesis gas thereby cooling said synthesis gas and forming a cooled synthesis gas;

passing said cooled synthesis gas into contact with a body of aqueous cooling liquid in a second contacting zone thereby forming a further cooled synthesis gas containing a decreased content of solid particles;

passing said further cooled synthesis gas containing decreased content of solid particles through a spray contacting zone wherein it is contacted with a spray of cooling liquid, at least a portion of said spray being directed toward the outlet of said spray contacting zone thereby decreasing deposition of solids in or adjacent to said outlet; and recovering said further cooled synthesis gas containing a decreased content of solid particles.

DESCRIPTION OF THE INVENTION

The hot synthesis gas which may be charged to the process of this invention may be a synthesis gas prepared by the gasification of coal. In the typical coal gasification process, the charge coal which has been finely ground typically to an average particle size of 20–500 microns preferably 30–300, say 200 microns, may be slurried with an aqueous medium, typically water, to form a slurry containing 40–80 w %, preferably 50–75 w %, say 60 w % solids. The aqueous slurry may then be admitted to a combustion chamber wherein it is contacted with oxygen-containing gas, typically air or oxygen, to effect incomplete combustion. The atomic ratio of oxygen to carbon in the system may be 0.7–1.2:1, say 0.9:1. Typically reaction is carried out at 1800° F.–2500° F., say 2500° F. and pressure of 100–1500 psig, preferably 500–1200, say 900 psig.

The synthesis gas may alternatively be prepared by the incomplete combustion of a hydrocarbon gas typified by methane, ethane, propane, etc. including mixtures of light hydrocarbon stocks or of a liquid hydrocarbon such as a residual fuel oil, asphalts, etc. or of a solid carbonaceous material such as coke from petroleum or from tar sands, bitumen, carbonaceous residues from coal hydrogenation processes, etc.

The apparatus which may be used in practice of this invention may include a gas generator such as is generally set forth in the following patents inter alia:

U.S. Pat. No. 2,818,326—Eastman et al
U.S. Pat. No. 2,896,927—Nagle et al
U.S. Pat. No. 3,998,609—Crouch et al
U.S. Pat. No. 4,218,423—Robin et al Effluent from the reaction zone in which charge is gasified to produce synthesis gas may be 1800° F.–2500° F., say 2500° F. at 100–1500 psig, preferably 500–1200 psig, say 900 psig.

Under these typical conditions of operation, the synthesis gas commonly contains (dry basis) 35–55 v %, say 44.7 v % carbon monoxide, 30–45 v %, say 35.7 v % hydrogen; 10–20 v %, say 18 v %, carbon dioxide, 0.3 v %–2 v %, say 1 v % hydrogen sulfide plus COS; 0.4–0.8 v %, say 0.5 v % nitrogen+argon; and methane in amount less than about 0.1 v %.

When the fuel is a solid carbonaceous material, the product synthesis gas may commonly contain solids (including ash, char, slag, etc.) in amount of 1–10 pounds, say 4 pounds per thousand SCF of dry product gas; and these solids may be present in particle size of less than 1 micron up to 3000 microns. The charge coal may contain ash in amount as little as 0.5 w % or as much as 40 w % or more. This ash is found in the product synthesis gas.

In accordance with practice of this invention, the hot synthesis gas at this initial temperature is passed downwardly through a first contacting zone. The upper extremity of the first contacting zone may be defined by the lower outlet portion of the reaction chamber of the gas generator. The first contacting zone may be generally defined by an upstanding preferably vertical perimeter wall forming an attenuated conduit; and the cross-section of the zone formed by the wall is in the preferred embodiment substantially cylindrical. The outlet or lower end of the attenuated conduit or dip tube at the lower extremity of the preferably cylindrical wall preferably bears a serrated edge.

The first contacting zone is preferably bounded by the upper portion of a vertically extending, cylindrical dip tube which has its axis colinear with respect to the combustion chamber.

At the upper extremity of the first contacting zone in the dip tube, there is mounted a quench ring through which cooling liquid, commonly water, is admitted to the first contacting zone. From the quench ring there is directed a first stream of cooling liquid along the inner surface of the dip tube on which it forms a preferably continuous downwardly descending film of cooling liquid which is in contact with the downwardly descending synthesis gas. Inlet temperature of the cooling liquid may be 100° F.–500° F., preferably 300° F.–480° F., say 420° F. The cooling liquid is admitted to the falling film on the wall of the dip tube in amount of 20–70, preferably 30–50, say 45 pounds per thousand SCF of gas admitted to the first contacting zone.

It is a feature of the process of this invention that the cooling liquid admitted to the contacting zones, and particularly that admitted to the quench ring, may include recycled liquids which have been treated to lower their solids content. Preferably those liquids will contain less than about 0.1 w % of solids having a particle size larger than about 100 microns, this being effected by hydrocloning.

As the falling film of cooling liquid contacts the downwardly descending hot synthesis gas, the temperature of the latter may drop by 200° F.–400° F., preferably 300° F.–400° F., say 300° F. because of contact with the falling film during its passage through the first contacting zone.

The gas may pass through the first contacting zone for 1–8 seconds, preferably 1–5 seconds, say 3 seconds at a velocity of 6–30, say 20 ft/sec. Gas exiting this first zone may have a reduced solids content, and be at a temperature of 1400° F.–2300° F., say 2200° F.

It is feature of the process of this invention, in its preferred aspects, that after exiting the first contacting zone, the velocity of gas be decreased to 3–15, say 9 ft/sec. This is preferably effected by passing the gas through a second contacting zone (in a lower expanded portion of the dip tube) of increased cross-sectional area. Typically the area of the expanded portion of the second contacting zone in the dip tube may be 140%–400%, say 225% of the area of the non-expanded portion of the first contacting zone.

The gas of decreased velocity leaves the lower extremity of the second contacting zone at typically 1000° F.–2100° F., say 2000° F. having been cooled in the second contacting zone by typically 100° F.–300° F., say 200° F.; and passes through the second contacting zone at a decreased velocity wherein it is cooled typically by 100° F.–300° F. The gas at decreased velocity passes into a third contacting zone wherein it contacts a body of cooling liquid. In this third contacting zone, the gas passes under a serrated edge of the preferably expanded portion of the dip tube.

The lower end of the dip tube is submerged in a pool of liquid formed by the collected cooling liquid which defines the third contacting zone. The liquid level, when considered as a quiescent pool, may typically be maintained at a level such that 10%–80%, say 50% of the third contacting zone is submerged. It will be apparent to those skilled in the art that at the high temperature and high gas velocities encountered in practice, there may of course be no identifiable liquid level during operation—but rather a vigorously agitated body of liquid.

The further cooled synthesis gas leaves the third contacting zone at typically 600° F.–900° F., say 800° F. (having been cooled therein by 100° F.–1500° F., say 400° F.) and it passes through the said body of cooling liquid in the third contacting zone and under the lower typically serrated edge of the dip tube. The solids fall through the body of cooling liquid wherein they are retained and collected and may be drawn off from a lower portion of the body of cooling liquid.

Commonly the gas leaving the third contacting zone may have had 75% or more of the solids removed therefrom.

The further cooled gas at 600° F.–900° F., say 800° F. leaving the body of cooling liquid which constitutes the third contacting zone is preferably passed together with cooling liquid upwardly through a preferably annular passageway through a fourth contacting zone toward the gas outlet of the quench chamber. In one embodiment, the annular passageway is defined by the outside surface of the dip tube forming the first cooling zone and the inside surface of the vessel which envelops or surrounds the dip tube and which is characterized by a larger radius than that of the dip tube.

In a more preferred embodiment, the annular passageway may be defined by the outside surface of the dip tube forming the first and second contacting zones and the inside surface of a circumscribing draft tube which envelopes or surrounds the dip tube and which is characterized by a larger radius than that of the dip tube.

As the mixture of cooling liquid and further cooled synthesis gas (at inlet temperature of 600° F.–900° F., say 800° F.) passes upwardly through the annular fourth cooling zone, the two phase flow therein effects efficient heat transfer from the hot gas to the cooling liquid: the vigorous agitation in this fourth cooling zone minimizes deposition of the particles on any of the contacted surfaces. Typically the cooled gas exits this annular fourth contacting zone at temperature of 350° F.–600° F., say 500° F. The gas leaving the fourth contacting zone contains 0.1–2.5, say 0.4 pounds of solids per 1000 SCF of gas i.e. about 85%–95% of the solids will have been removed from the gas.

In one embodiment of this invention, the mixture of gas and liquid leaving the fourth contacting zone is directed into contact with a baffle which is placed within the path of the exiting stream as a vapor-liquid disengagement zone wherein the vapor is disengaged from the vapor-liquid mixture. Preferably this baffle is mounted on the outer surface of the dip tube at a point adjacent to that at which the stream exits the contacting zone. Typically this point is above the static liquid level and the upper terminus of the draft tube when the latter is present.

The baffle is arcuate in cross-section and is curved in manner to direct the upflowing mixture of liquid and gas away from the dip tube and downwardly toward the bottom of the quench chamber. The gas thereafter passes upwardly toward the outlet of the quench chamber, as the liquid and solids are directly downwardly.

It is a feature of this invention that the cooled product exiting synthesis gas and cooling liquid are passed (by the velocity head of the stream) toward the exit of the quench chamber and thence into the exit conduit which is preferably aligned in a direction radially with respect to the circumference of the shell which encloses the combustion chamber and quench chamber.

In practice of the process of this invention according to certain of its aspects, it is preferred to introduce a directed stream or spray of cooling liquid into the stream of cooled quenched product synthesis gas, in a spray contacting zone, at the point at which it enters the exit conduit or outlet nozzle and passes from the quench chamber to a venturi scrubber through which the product synthesis gas passes. In the preferred embodiment, this directed stream or spray of cooling liquid is initiated at a point on the axis of the outlet nozzle and it is directed along that axis toward the nozzle and the venturi which is preferably mounted on the same axis.

Although this stream will effect some additional cooling of the product synthesis gas, it is principally believed to be advantageous in that it minimizes, and in preferred operation eliminates, the deposition, in the outlet nozzle and the venturi scrubber, of solids which are derived from the ash and char which originate in the synthesis gas and which may not have been completely removed by the contacting in the several contacting zones.

This last directed stream of liquid at 100° F.–500° F., say 420° F. is preferably admitted in amount of 5–25, say 11 pounds per hour per 1000 SCF of dry gas.

Cooling liquid may be withdrawn as quench bottoms from the lower portion of the quench chamber; and the withdrawn cooling liquid contains solidified ash and char in the form of small particles. If desired, additional cooling liquid may be admitted to and/or withdrawn from the body of cooling liquid in the lower portion of the quench chamber.

It will be apparent that this sequence of operations is particularly characterized by the ability to remove a substantial portion of the solid (ash, slag, and char) particles which would otherwise contribute to formation of agglomerates which block and plug the equipment. It will also be found that the several cooling (and washing) operations remove from the gas the small quantity of water-soluble solids which may act as interparticle binder-binding together the smaller particles into undersirable larger agglomerates.

The several cooling and washing steps insure that the fine particles of ash are wetted by the cooling liquid and thereby removed from the gas.

DESCRIPTION OF PREFERRED EMBODIMENTS

Figure 1:
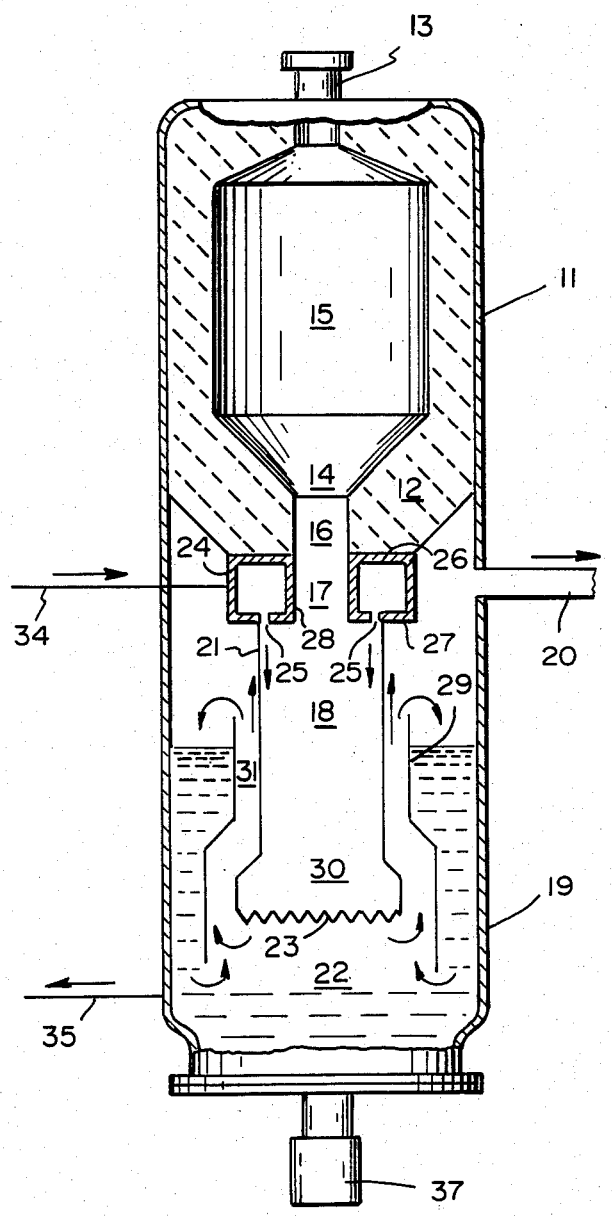
FIG. 1 is a schematic vertical section of a preferred embodiment of this invention illustrating a generator and associated therewith a quench chamber.

Practice of this invention will be apparent to those skilled in the art from the following.

EXAMPLE I

In this Example which represents the best mode of practicing the invention known to me at this time, there is provided a reaction vessel 11 having a refractory lining 12 and inlet nozzle 13. The reaction chamber 15 has an outlet portion 14 which includes a narrow throat section 16 which feeds into opening 17. Opening 17 leads into first contacting zone 18 inside of dip tube 21. The lower extremity of dip tube 21, which bears serrations 23, is immersed in bath 22 of quench liquid. The quench chamber 19 includes, preferably at an upper portion thereof, a gas discharge conduit 20.

A quench ring 24 is mounted at the upper end of dip tube 21. This quench ring may include an upper surface 26 which preferably rests against the lower portion of the lining 12 of vessel 11. A lower surface 27 of the quench ring preferably rests against the upper extremity of the dip tube 21. The inner surface 28 of the quench ring may be adjacent to the edge of opening 17.

Quench ring 24 includes outlet nozzles 25 which may be in the form of a series of holes or nozzles around the periphery of quench ring 24—positioned immediately adjacent to the inner surface of dip tube 21. The liquid projected through passageways or nozzles 25 passes in a direction generally parallel to the axis of the dip tube 21 and forms a thin falling film of cooling liquid which descends on the inner surface of dip tube 21. This falling film of cooling liquid forms an outer boundary of the first contacting zone.

At the lower end of the first contacting zone 18, there is a second contacting zone 30 which extends downwardly toward serrations 23 and which is also bounded by that portion of the downwardly descending film of cooling liquid which is directed towards the wall on the lower portion of dip tube 21.

In the preferred embodiment of FIG. 1, the dip tube 21 which defines the first contacting zone is expanded at its lower portion 30, the cross-sectional area at the most expanded portion 30 being 225% of the cross-sectional area at the main portion of dip tube 21. The velocity of the downwardly flowing gas is slowed as it passes through the second contacting zone, defined in part by the expanded lower portion 30. The increased linear (i.e. circumferential) length of the serrated edge 23 provides greater area of contact between the flowing gas and the body of liquid 22 and increases the contact time by reducing the velocity of the gas thereby providing better, or more intimate, gas-liquid contact.

The gas flows across serrations 23, through the body of liquid 22 in the third contacting zone(which is adjacent and/or below serrations 23), and thence upwardly between the outer circumference of dip tube 21 and draft tube 29, i.e. through the annulus 31.

As the gas and liquid (containing solids which have been washed out of the gas) pass upwardly out of the upper end of the third contacting zone 31, the gas continues upwardly through the fourth contact zone 31 wherein vigorous vapor-liquid contact is obtained, and toward the gas discharge conduit 20. The liquid, and the solids contained therein, fall back toward the lower portion of the quench chamber and the body of liquid 22.

The cooled gas leaving through conduit 20 is found to be characterized by a decreased content of solids.

EXAMPLE II

Figure 2:
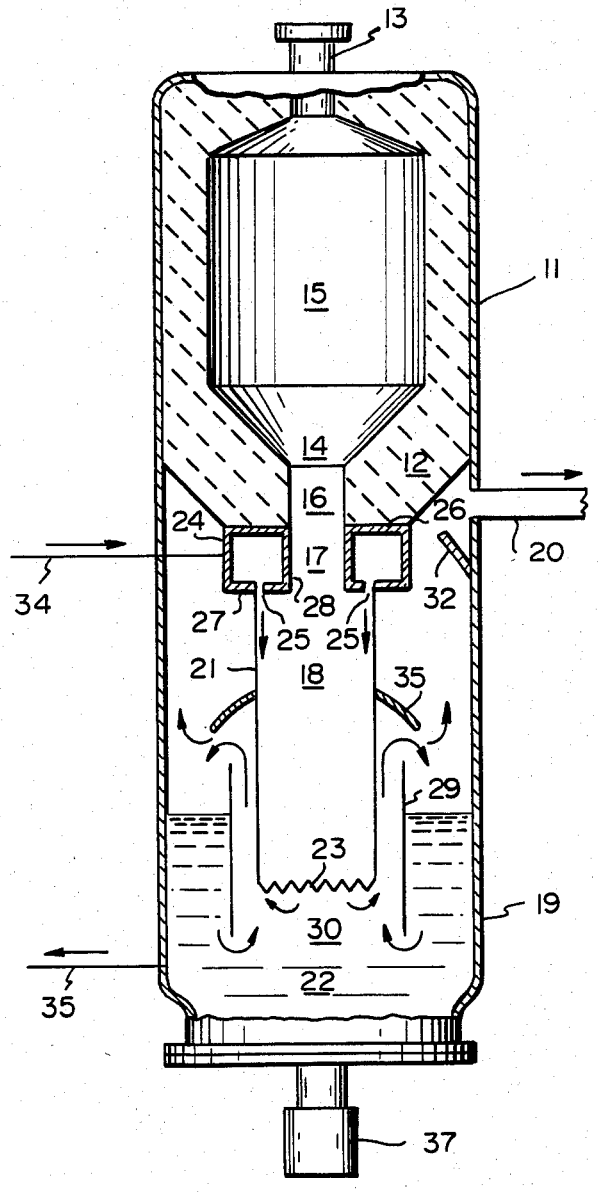
FIGS. 2 and 3 disclose alternative embodiments of the apparatus of this invention.

There is set forth in FIG. 2 a less preferred embodiment wherein the structure includes many of the features of the structure of FIG. 1. FIG. 2 includes an arcuate baffle 35. As the gas-liquid mixture exits the annular portion of the contacting zone 30, between dip tube 21 and draft tube 29 it is directed into the baffle 35. At this point, the liquid (including the solid suspended therein) is passed through an arcuate path toward the lower portion of quench chamber 19. The gas which passes upwardly past the edge of baffle 31 is denuded of liquid and solids. Exit baffle 32 knocks out additional liquid from the gas which exits through gas discharge conduit 20.

EXAMPLE III

Figure 3:
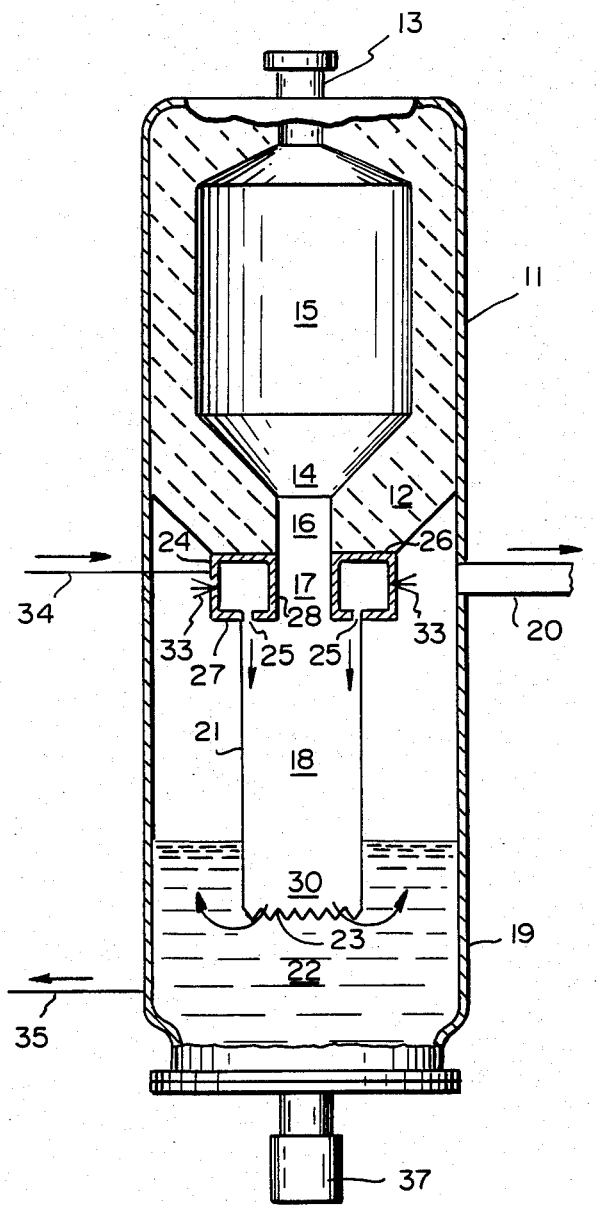

There is set forth in FIG. 3 a less preferred embodiment of the invention wherein the structure includes many of the features of the structure of FIG. 1. It is a feature of the structure of FIG. 3 that it includes nozzles 33 which direct a spray of cooling liquid from quench ring 24 to the upper portion of the quench chamber 19. This stream serves to further cool the gas and to prevent deposition of solids in gas discharge conduit 20.

EXAMPLE IV

In operation of the process of this invention utilizing the preferred embodiment of the apparatus of FIG. 1, there is admitted through inlet nozzle 13, a slurry containing 100 parts per unit time (all parts are parts by weight unless otherwise specifically stated) of charge coal and 60 parts of water. This charge is characterized as follows:

TABLE

| Component | WEIGHT % (dry) |
|---|---|
| Carbon | 67.6 |
| Hydrogen | 5.2 |
| Nitrogen | 3.3 |
| Sulfur | 1.0 |
| Oxygen | 11.1 |
| Ash | 11.8 |

There are also admitted 90 parts of oxygen of purity of 99.5 v %. Combustion in chamber 15 raises the temperature to 2500° F. at 900 psig. Product synthesis gas, passed through outlet portion 14 and throat section 16, may contain the following gaseous components:

TABLE

| Component | Volume % | |
|---|---|---|
| | Wet Basis | Dry Basis |
| CO | 35.7 | 44.7 |
| $H_2$ | 28.5 | 35.7 |
| $CO_2$ | 14.4 | 18 |
| $H_2O$ | 20 | — |
| $H_2S$ + COS | 0.9 | 1.1 |
| $N_2$ + Argon | 0.4 | 0.5 |
| $CH_4$ | 0.08 | 0.1 |

This synthesis gas may also contain about 4.1 pounds of solid (char and ash) per 1000 SCF dry gas.

The product synthesis gas (235 parts) leaving the throat section 16 passes through the opening 17 in the quench ring 24 into first contacting zone 18. Aqueous cooling liquid at 420° F. is admitted through inlet line 34 to quench ring 24 from which it exits through outlet nozzles 25 as a downwardly descending film on the inner surface of dip tube 21 which defines the outer boundary of first contacting zone 18. As synthesis gas, entering the first contacting zone at about 2500° F., passes downwardly through the zone 18 in contact with the falling film of aqueous cooling liquid, it is cooled to about 2150° F.–2200° F.

The so-cooled synthesis gas is then admitted to the second contacting zone 30 which is characterized by the presence of expanded lower portion of dip tube 21, the expanded portion of the second contacting zone having a cross-sectional area which is 225% of that of the first contacting zone. The downward velocity of the gas, which was 20 feet per second, is decreased to 9 feet per second in area 30. At this lower velocity the gas leaves the second contacting zone and at 2000° F. and enters the third contacting zone wherein it passes under serrated edge 23 into contact with the body 22 of liquid. Although the drawing shows a static representation having a delineated "water-line", it will be apparent that in operation, the gas and the liquid in the third contacting zone will be in violent turbulence as the gas passes downwardly through the body of liquid, leaves the dip tube 21 passing serrated edge 23 thereof, and passes upwardly through the body of liquid outside the dip tube 21. The area between the outside surface of the dip tube and the inside surface of the conforming draft tube, in the preferred embodiment, defines the fourth contacting zone. The inlet temperature to this zone may be 800° F. and the outlet temperature 500° F.

The further cooled synthesis gas, during its contact with cooling liquids loses at least a portion of its solids content. Typically the further cooled synthesis gas containing a decreased content of ash particles leaving the body of liquid 22 in third contacting zone contains solids (including ash and char) in amount of about 0.6 pounds per 1000 SCF dry gas.

Cooling water may be drawn off through line 35 and solids collected may be withdrawn through line 37.

The exiting gas at 500° F. is withdrawn from the cooling system through gas discharge conduit 20; and it commonly passes through a venturi thereafter wherein it may be mixed with further cooling liquid for additional cooling and/or loading with water. This venturi is preferably immediately adjacent to the outlet nozzle.

Although this invention has been illustrated by reference to specific embodiments, it will be apparent to those skilled in the art that various changes and modifications may be made which clearly fall within the scope of this invention.

I claim:

1. A synthesis gas generation apparatus including means defining a vertically extending synthesis gas generation zone having a lower outlet through which hot synthesis gas is withdrawn;

means defining a vertically extending quench chamber below said vertically extending synthesis gas generation zone and having a hot synthesis gas inlet therein joining said lower outlet of said gas generation zone whereby hot synthesis gas is admitted to said quench chamber, said quench chamber further including a body of cooling liquid therein;

an attenuated vertically extending dip tube in said quench chamber having inner and outer perimetric surfaces, and an upper inlet end through which hot synthesis gas entering said quench chamber is admitted to said dip tube through which said gas moves toward an oulet end of said dip tube located within said body of liquid;

a quench ring adjacent to the inner perimetric surface at the inlet end of said dip tube for directing a curtain of liquid along the inner perimetric surface of said dip tube and toward the outlet end of said dip tube;

means defining an expanded outlet portion of said dip tube including the outlet end thereof, said expanded portion having an area between about 140 to 400% of the area of the non-expanded portion of the dip tube; and serrations on the outlet end of said expanded outlet portion of said dip tube;

whereby charge gas admitted to the inlet end of said dip tube may be passed downwardly through (i) a first contacting zone in said dip tube wherein it is contacted with a film of cooling liquid passing downwardly therethrough, (ii) a second contracting zone in said expanded portion of said dip tube wherein the velocity of said downwardly descending charge gas is decreased, and then through (iii) a third contacting zone adjacent to the lower outlet end of said dip tube wherein gas is contacted with a body of cooling liquid, and thence to the quench gas outlet of said quench chamber.

2. A synthesis gas generation apparatus including means defining a vertically extending synthesis gas generation zone having a lower outlet through which hot synthesis gas is withdrawn;

means defining a vertically extending quench chamber below said vertically extending synthesis gas generation zone and having a hot synthesis gas inlet therein joining said lower outlet of said gas generation zone whereby hot synthesis gas is admitted to said quench chamber, said quench chamber including a body of cooling liquid therein;

an attenuated vertically extending dip tube in said quench chamber having inner and outer perimetric surfaces, and an upper inlet end through which hot synthesis gas entering said quench chamber is admitted to said dip tube through which said gas moves toward an outlet end of said dip tube located within said body of liquid;

a quench ring adjacent to the inner perimetric surface at the inlet end of said dip tube for directing a curtain of liquid along the inner perimetric surface of said dip tube and toward the outlet end of said dip tube;

means defining an expanded outlet portion of said dip tube including the outlet end thereof, said expanded portion having an area between about 140 to 400% of the area of the non-expanded portion of the dip tube;

serrations on the outlet and of said expanded outlet portion of said dip tube; and an attenuated draft tube enveloping the lower portion of said dip tube including said expanded portion of said dip tube and forming an annular passageway between said dip tube and said draft tube;

whereby charge gas admitted to the inlet end of said dip tube may be passed downwardly through (i) a first contacting zone in said dip tube wherein it is contacted with a film of cooling liquid passing downwardly therethrough, (ii) a second contacting zone in said expanded portion of said dip tube wherein the velocity of said downwardly descending charge gas is decreased, and then through (iii) a third contacting zone adjacent to the lower outlet end of said dip tube and including said annular passageway wherein gas is contacted with a body of cooling liquid, and thence to the quench gas outlet of said quench chamber.

* * * * *